US009557115B2

(12) United States Patent
Jukkola et al.

(10) Patent No.: US 9,557,115 B2
(45) Date of Patent: Jan. 31, 2017

(54) ORIFICE PLATE FOR CONTROLLING SOLIDS FLOW, METHODS OF USE THEREOF AND ARTICLES COMPRISING THE SAME

(75) Inventors: Glen D. Jukkola, Glastonbury, CT (US); Bard C. Teigen, Enfield, CT (US)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 1317 days.

(21) Appl. No.: 13/283,411

(22) Filed: Oct. 27, 2011

(65) Prior Publication Data

US 2012/0111535 A1 May 10, 2012

Related U.S. Application Data

(60) Provisional application No. 61/407,706, filed on Oct. 28, 2010, provisional application No. 61/407,741,
(Continued)

(51) Int. Cl.

| | |
|---|---|
| ***F23C 10/18*** | (2006.01) |
| ***F22B 31/08*** | (2006.01) |
| ***F23C 10/04*** | (2006.01) |
| ***B01D 51/00*** | (2006.01) |
| ***F01K 3/00*** | (2006.01) |
| ***F28C 3/00*** | (2006.01) |
| ***F28C 3/14*** | (2006.01) |

(Continued)

(52) U.S. Cl.

CPC ..... *F28C 3/14* (2013.01); *F28D 13/00* (2013.01); *F28F 9/026* (2013.01); *F28F 27/02* (2013.01); *F28D 2021/0045* (2013.01)

(58) Field of Classification Search

None

See application file for complete search history.

(56) References Cited

U.S. PATENT DOCUMENTS

| | | | |
|---|---|---|---|
| 2,316,814 | A | 4/1943 | Schemm |
| 2,756,981 | A | 7/1956 | Muller |

(Continued)

FOREIGN PATENT DOCUMENTS

| | | | |
|---|---|---|---|
| CN | 1042412 | A | 5/1990 |
| CN | 1279312 | C | 10/2006 |

(Continued)

OTHER PUBLICATIONS

State Intellectual Property Office of People's Republic of China—Office Action dated Aug. 15, 2014 for CN Appln. No. 201180063313.6.

(Continued)

*Primary Examiner* — Gregory Huson
*Assistant Examiner* — Eric Gorman
(74) *Attorney, Agent, or Firm* — GE Global Patent Operation; Stephen G. Midgley

(57) ABSTRACT

Disclosed herein is an orifice plate comprising one or more plates having orifices disposed therein; the orifices being operative to permit the flow of solids from a moving bed heat exchanger to a solids flow control system; where the orifice plate is downstream of a tube bundle of the moving bed heat exchanger and upstream of the solids flow control system and wherein the orifice plate is operative to evenly distribute the flow of solids in the solids flow control system.

13 Claims, 8 Drawing Sheets

Related U.S. Application Data filed on Oct. 28, 2010, provisional application No. 61/407,694, filed on Oct. 28, 2010.

(51) Int. Cl.

| | |
|---|---|
| ***F28C 3/16*** | (2006.01) |
| ***F28D 9/00*** | (2006.01) |
| ***F28F 9/02*** | (2006.01) |
| ***F28F 27/02*** | (2006.01) |
| ***F28D 13/00*** | (2006.01) |
| *F28D 21/00* | (2006.01) |

(56) References Cited

U.S. PATENT DOCUMENTS 3,563,006 A 2/1971 Sutter
3,679,271 A 7/1972 Clark et al.
3,932,173 A * 1/1976 Collin ..... C22B 4/00 266/186
4,084,545 A 4/1978 Nack et al.
4,279,207 A * 7/1981 Wormser ..... F22B 31/0007 110/345
4,307,773 A * 12/1981 Smith ..... F28D 19/02 165/104.16
4,479,353 A 10/1984 Schluderberg
4,501,599 A 2/1985 Loukos
4,624,305 A * 11/1986 Rojey ..... F28F 3/086 165/165
4,659,340 A * 4/1987 Weaver ..... C10J 3/26 110/229
4,683,840 A 8/1987 Morin
4,687,497 A 8/1987 Owen et al.
4,777,889 A 10/1988 Smith
4,869,207 A 9/1989 Engstrom et al.
4,909,676 A 3/1990 Heep et al.
4,955,295 A 9/1990 Abdulally
4,969,930 A 11/1990 Arpalahti
5,133,943 A 7/1992 Abdulally
5,275,788 A 1/1994 Stoholm
5,339,774 A 8/1994 Tang
5,441,406 A 8/1995 Bunk et al.
5,676,281 A 10/1997 Reier
5,682,828 A 11/1997 Phalen et al.
5,711,233 A 1/1998 Martin et al.
6,076,596 A * 6/2000 Osakabe ..... F28D 15/0266 165/104.21
6,269,778 B1 8/2001 Anderson et al.
6,293,112 B1 * 9/2001 Moeykens ..... F25B 39/02 165/115
6,357,517 B1 * 3/2002 Osakabe ..... H01L 23/427 165/104.21
6,418,866 B1 7/2002 Shimizu et al.
6,457,425 B1 10/2002 Crafton
6,589,778 B1 * 7/2003 Hawkins ..... B01L 3/5027 435/287.2
6,684,917 B2 2/2004 Zhu et al.
6,764,253 B1 7/2004 Pfeiffer
6,868,695 B1 * 3/2005 Dingel ..... F25B 39/028 165/115
6,923,128 B2 8/2005 Seeber
7,194,983 B2 3/2007 Kokko
7,329,071 B2 2/2008 Sonnichsen
7,448,831 B2 11/2008 Brown et al.
7,553,111 B2 6/2009 Salmento et al.
7,937,943 B2 * 5/2011 Cao ..... F01B 29/10 123/64
8,225,936 B2 7/2012 Bligh et al.
2002/0084059 A1 * 7/2002 Rittberger ..... F28D 9/005 165/54
2002/0192039 A1 12/2002 Pfeiffer et al.
2003/0019612 A1 * 1/2003 Osakabe ..... F28D 1/0333 165/104.11
2003/0037730 A1 * 2/2003 Yamasaki ..... C23C 16/18 118/715
2003/0079863 A1 * 5/2003 Sugito ..... F28D 15/0266 165/104.21
2004/0037658 A1 2/2004 Pfeiffer et al.
2005/0064357 A1 3/2005 Watanabe
2005/0155749 A1 * 7/2005 Memory ..... F28D 9/0075 165/167
2005/0205015 A1 * 9/2005 Sasaki ..... C23C 16/45565 118/723 MA
2006/0154190 A1 * 7/2006 Reiser ..... F23C 13/00 431/18
2007/0183854 A1 8/2007 Sonnichsen
2008/0029001 A1 * 2/2008 Matsui ..... F16K 3/085 110/244
2008/0031697 A1 2/2008 Berggren
2008/0202735 A1 * 8/2008 Geskes ..... F28D 9/0006 165/166
2009/0151902 A1 6/2009 Jacobs et al.
2009/0304465 A1 12/2009 Greenwood et al.
2010/0101760 A1 4/2010 Wedde et al.
2010/0189518 A1 7/2010 Roumieu et al.
2011/0315350 A1 * 12/2011 Curtis ..... F28D 5/02 165/104.21
2013/0174783 A1 * 7/2013 Suzuki ..... C23C 16/45565 118/725
2013/0336860 A1 * 12/2013 Bjarno ..... B01D 53/504 423/210

FOREIGN PATENT DOCUMENTS

CN 101641462 A 2/2010
CN 101754918 A 6/2010
DE 1401704 A1 10/1968
DE 1920889 11/1970
DE 19629289 A1 1/1998
DE 197 23 159 12/1998
EP 0226140 A2 6/1987
EP 0543100 A1 5/1993
EP 1816095 A1 8/2007
GB 1102264 2/1968

OTHER PUBLICATIONS

Glen D. Jukkola et al., U.S. Appl. No. 61/407,706, filed Oct. 28, 2010.
Zenz et al., "Fluidization and Fluid-Particle Systems", Reinhold Chemical Engineering Series, Reinhold, NY, 50 pages, 1960.
PCT Search Report and Written Opinion issued in connection with related PCT Application No. PCT/US2011/058245 on Feb. 6, 2012.
Non-Final Office Action issued in connection with related U.S. Appl. No. 13/283,355 on Mar. 1, 2013.
Final Office Action issued in connection with related U.S. Appl. No. 13/283,355 on Sep. 25, 2013.
European Office Action issued in connection with related EP Application No. 11781929.2 on Feb. 20, 2014.
Non-Final Office Action issued in connection with related U.S. Appl. No. 13/283,355 on Feb. 26, 2014.
Unofficial English translation of Chinese Office Action and Search Report issued in connection with related CN Application No. 201180063296.6 on Apr. 30, 2014.
Final Office Action issued in connection with related U.S. Appl. No. 13/283,355 on Jul. 16, 2014.
US Advisory Action issued in connection with related U.S. Appl. No. 13/283,355 on Oct. 9, 2014.
Federal Highway Administration, "User Guidelines for Waste and Byproduct Materials in Pavement Construction", US Department of Transportation, Publication No. FHWA-RD-97-148, Nov. 2014.
Non-Final Office Action issued in connection with related U.S. Appl. No. 13/283,355 on Apr. 8, 2015.
Final Office Action issued in connection with related U.S. Appl. No. 13/283,355 on Sep. 11, 2015.
Non-Final Office Action issued in connection with related U.S. Appl. No. 13/283,355 on Jun. 14, 2016.

(56) References Cited

OTHER PUBLICATIONS

Notice of Allowance issued from related U.S. Appl. No. 13/283,355 dated Dec. 7, 2016.

* cited by examiner

Figure 5 (Top View)

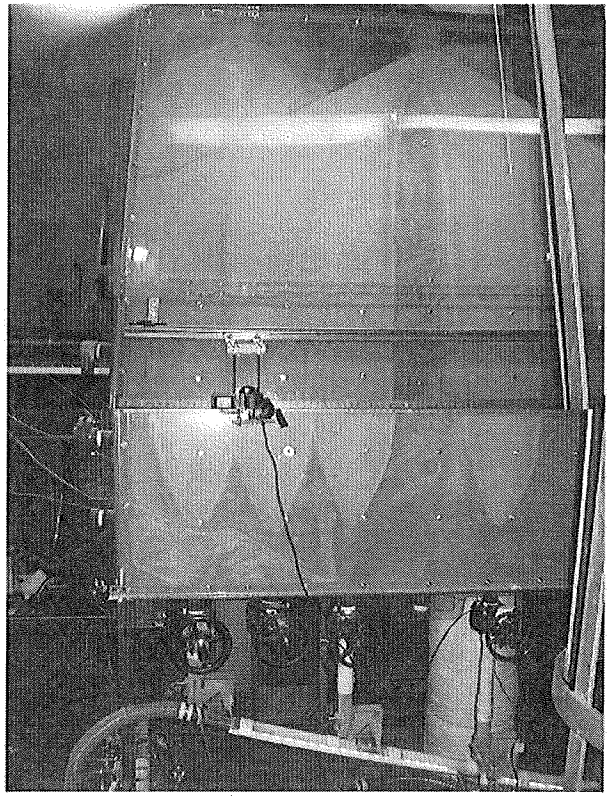
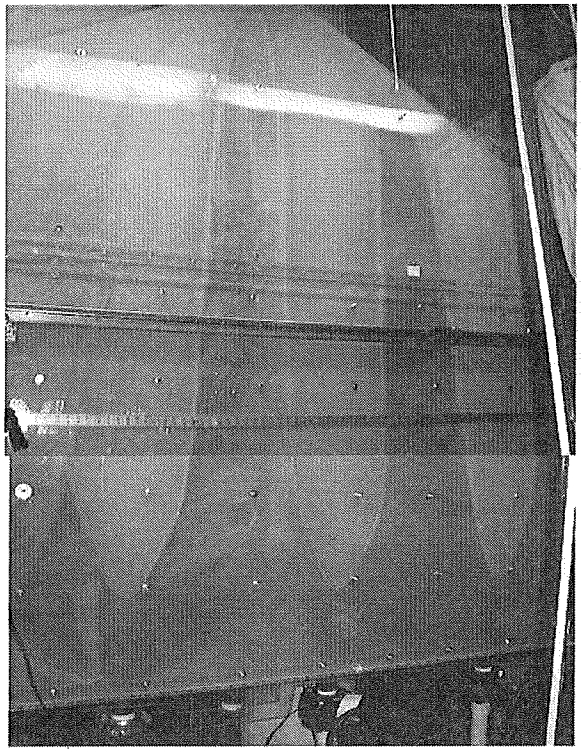
Figure 7

ORIFICE PLATE FOR CONTROLLING SOLIDS FLOW, METHODS OF USE THEREOF AND ARTICLES COMPRISING THE SAME

CROSS-REFERENCE TO RELATED APPLICATIONS

This disclosure claims priority to U.S. Provisional Application No. 61/407,706, filed on Oct. 28, 2010 and to U.S. Provisional Application No. 61/407,741, filed on Oct. 28, 2010 and to U.S. Provisional Application No. 61/407,694, filed on Oct. 28, 2010, the entire contents of which are incorporated herein by reference.

STATEMENT REGARDING FEDERALLY SPONSORED RESEARCH OR SUPPORT

The United States Government has rights in this invention pursuant to a grant having contract No. DE-FC26-OINT41223 from the U.S. Department of Energy/National Energy Technology Laboratory (NETL).

TECHNICAL FIELD

This disclosure relates to an orifice plate for solids flow control. This disclosure relates to an orifice plate for solids flow control in a moving bed heat exchanger. This disclosure also relates to methods of using the orifice plate and to articles that contain the orifice plate.

BACKGROUND

In some thermal processes (e.g., processes involved in the generation of energy) or manufacturing processes (e.g., processes involved in the production of metals or plastics) it is desirable to continuously move solids. For example, in the generation of energy, it is desirable to transfer heat from hot solids and/or ashes to a cooling medium in a heat exchanger. In order to do so, the hot solids are transported to a moving bed heat exchanger where they exchange their heat with a cooling medium that comprises water, steam or oil. In the moving bed heat exchanger it is desirable to move and discharge the solids uniformly so that the temperatures across the moving bed heat exchanger are uniform.

If the hot solids and/or ashes in the moving bed heat exchanger are not moved and discharged uniformly, then large temperature differences can be found across the heat exchanger and these large temperature differences lead to inefficiencies in the heat exchanger or to component failure. Solids flow mal-distribution can lead to poor heat transfer performance, ineffective surface utilization, conditions exceeding allowable temperature and/or stress, and possibly steam temperature imbalances.

It is therefore desirable to develop a flow control system for the processes that involve the flow of solids so that solids can be transferred without any mal-distribution or imbalances that lead to an inefficient process.

SUMMARY

Disclosed herein is an orifice plate comprising one or more plates having orifices disposed therein; the orifices being operative to permit the flow of solids from a moving bed heat exchanger to a solids flow control system; where the orifice plate is downstream of a tube bundle of the moving bed heat exchanger and upstream of the solids flow control system.

Disclosed herein too is a moving bed heat exchanger comprising an enclosure having side walls, a roof and a floor; a tube bundle disposed within the enclosure; the tube bundle being operative to transport a cooling fluid; wherein the spaces between tubes of the tube bundle are operative to permit transport of hot solids and/or ash; an orifice plate disposed downstream of the tube bundle and the floor of the moving bed heat exchanger; the orifice plate comprising one or more plates having orifices disposed therein; the orifices being operative to permit the flow of solids from the moving bed heat exchanger to a solids flow control system; where the solids flow control system is located downstream of the moving bed heat exchanger.

Disclosed herein too is a method comprising discharging solids from a moving bed heat exchanger to a solids flow control system through an orifice plate, the orifice plate comprising one or more plates having orifices or hoppers disposed therein; wherein the orifices or the hoppers are operative to permit the flow of solids from the moving bed heat exchanger to a solids flow control system; where the solids flow control system is located downstream of the moving bed heat exchanger; and forming a pile of solids adjacent to an orifice or a hopper on at least one orifice plate; wherein the pile of solids serves to guide additional solids discharged from the moving bed heat exchanger into another orifice or into another hopper.

BRIEF DESCRIPTION OF THE FIGURES

FIG. 7 is a photograph of a slice model of a moving bed heat exchanger that does not have an orifice plate.

DETAILED DESCRIPTION

Disclosed herein is an orifice plate for use in a moving bed heat exchanger solids flow control system that controls the flow of high temperature solids (also know as high temperature ash) as they exit a moving bed heat exchanger and are transported to a combustion chamber, a reactor or receiving hopper. The orifice plate can also be used in other solids transfer devices where solids are to be transported. In one embodiment, the orifice plate can also be used in other solids transfer devices where irregularly shaped solids are to be transported. For example, it can be used in the delivery system for smelting operations, where metal ores (e.g., bauxites, ferrites, and the like) are transported to a furnace for smelting.

The solids flow control system controls the flow of high temperature solids as they exit the moving bed heat exchanger, which in turn leads to control of the flow of solids within the moving bed heat exchanger. In an exemplary embodiment, the solids are hot solids and/or ash from the moving bed heat exchanger. The solids flow control system comprises the orifice plate for uniform distribution of solids throughout the moving bed heat exchanger. The orifice plate is disposed between the moving bed heat exchanger tube bundles and a solids flow control valve system. The solids flow valve system advantageously has no moving parts, which minimizes maintenance and improves reliability. It uses only an air pressure of up to about 4 pounds per square inch to facilitate transportation of solids back to a combustor or receiving hopper. The lack of moving parts in the solids flow control system makes the entire system easy to construct and to maintain.

Figure 1:
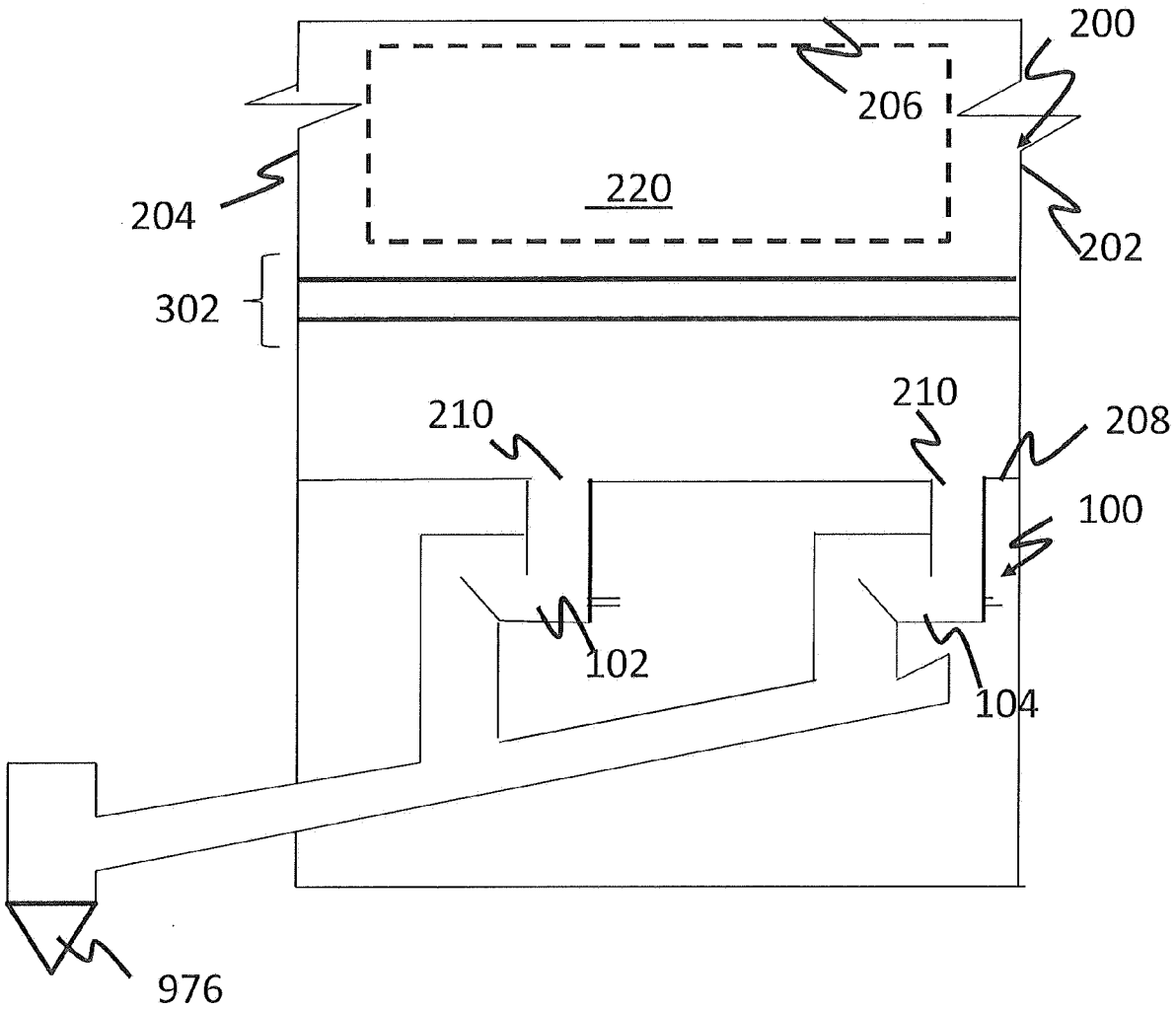
FIG. 1 depicts the solids flow control system for a moving bed heat exchanger that comprises a plurality of solids flow control valves.
Figure 2:
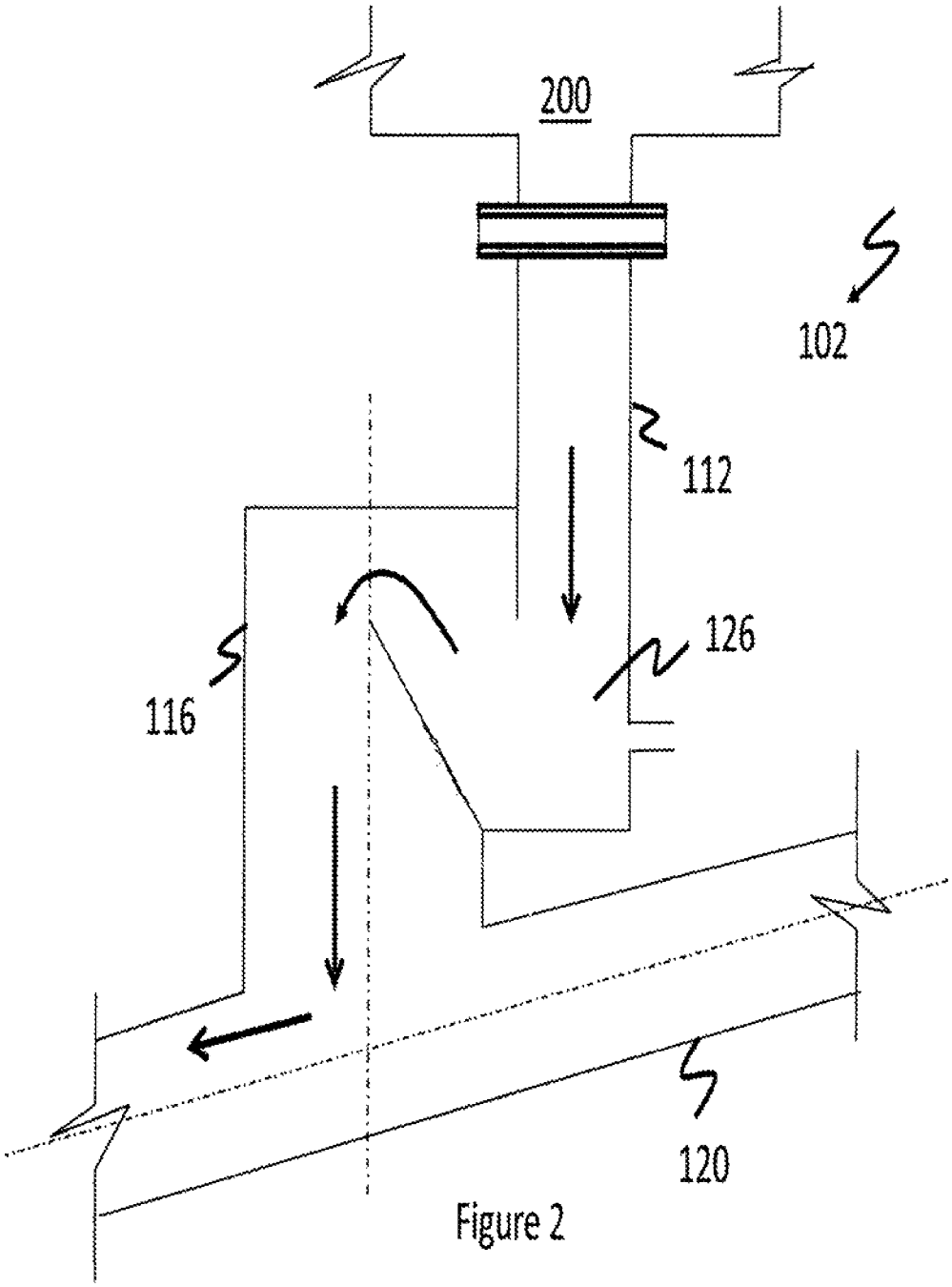
FIG. 2 is an enlarged depiction of the solids control flow valve showing the direction of flow of hot solids and/or ash.

FIGS. 1 and 2 depict the solids flow control system 100 for a moving bed heat exchanger 200 that comprises a plurality of valves 102, 104. Each valve 102, 104 comprises a standpipe 112, a shoe 126, and a housing 116. As depicted by the arrows in the FIG. 2, hot solids and/or ash from the moving bed heat exchanger 200 travels from the moving bed heat exchanger through the valve 102 into a transport conduit 120 to a combustor (not shown). With reference to the FIG. 2, the hot solids and/or ash travels from the moving bed heat exchanger 200 through the standpipe 112, the shoe 126 and the housing 116 before entering the transport conduit 120 from which they are transported to the combustion chamber 976 or to a reactor (not shown) or a transportation hopper (hot shown).

The solids flow control system 100 is disposed downstream of the moving bed heat exchanger 200 and in operative communication with it. The solids flow control system 100 is generally located upstream of the combustion chamber 976 or the reactor or the hopper. In one embodiment, the solids flow control system 100 is disposed directly below the moving bed heat exchanger 200 and contacts an opening 210 in the floor or the moving bed heat exchanger. As shown in the FIG. 1, the moving bed heat exchanger 200 comprises an enclosure 202 that contains a number of tubes. The tubes are termed heat exchanger tube bundles 220. The enclosure 202 is formed by vertical walls 204 of the moving bed heat exchanger, a roof 206 that contacts the vertical walls and a floor 208 that also contacts the vertical walls 204. The moving bed heat exchanger receives hot solids and/or ashes from the circulating fluidized bed boiler cyclone loop seal or from the combustor.

The tubes (of the tube bundle 220) in the moving bed heat exchanger 200 are arranged in one or more tube bundles, each having a multiplicity of tubes and arrangements. The cooling medium is generally water, thermal coolant, or steam. The heating or cooling medium flows through the tubes. Cooling medium and product (e.g., hot solids and/or ash) flow occurs in cross, parallel, or countercurrent to each other. The coolers work according to the moving bed principle, i.e., the hot solids and/or ash forms a product column which flows continuously downwards between the cooling pipes. Heat is transferred from the hot solids and/or ash through the tube walls to the cooling medium.

The orifice plate 302 is disposed proximate to the floor 208 of the moving bed heat exchanger between the solids flow control system 100 and the moving bed heat exchanger tube bundles 220. In one embodiment, the orifice plate 302 lies downstream of a tube bundle (not shown) of the moving bed heat exchanger and upstream of the solids flow control system 100. While the orifice plate 302 is depicted by solid lines in the FIGS. 1 and 2, each orifice plate comprises a plurality of orifices. The arrangement of these orifices within each of the plates and the arrangement of the orifice plates will be described in detail below.

The orifice plate 302 regulates distribution of the hot solids and/or the ash in the moving bed heat exchanger as they flow downwards towards the floor 208 of the moving bed heat exchanger 200 and towards the solids flow control valve system 100.

The orifice plate 302 is disposed across the entire cross-sectional area of the moving bed heat exchanger 200 and in one embodiment, may be parallel to the floor 208 of the heat exchanger 200. In another embodiment, the orifice plate 302 may not be parallel to the floor 208 of the heat exchanger 200. The orifice plate 302 comprises one or more plates each of which contact the side walls of the moving bed heat exchanger 200. In an exemplary embodiment, the orifice plate 302 is parallel to the floor 208 of the heat exchanger 200.

As shown in the FIG. 3, the orifice plate 302 comprise one or more plates each of which has a plurality of holes through which the solids discharged from the moving bed heat exchanger tube bundle can travel uniformly to the ash control valves below the moving bed heat exchanger and from the moving bed heat exchanger to the combustor. In one embodiment, the orifice plate comprise a plurality of plates, each plate of which has fewer holes of larger diameter than that of the plate above. The total cross-sectional area of the orifices (i.e., the sum of the cross-sectional area of the orifices) in the successive plates is generally equal to one another.

Figure 3:
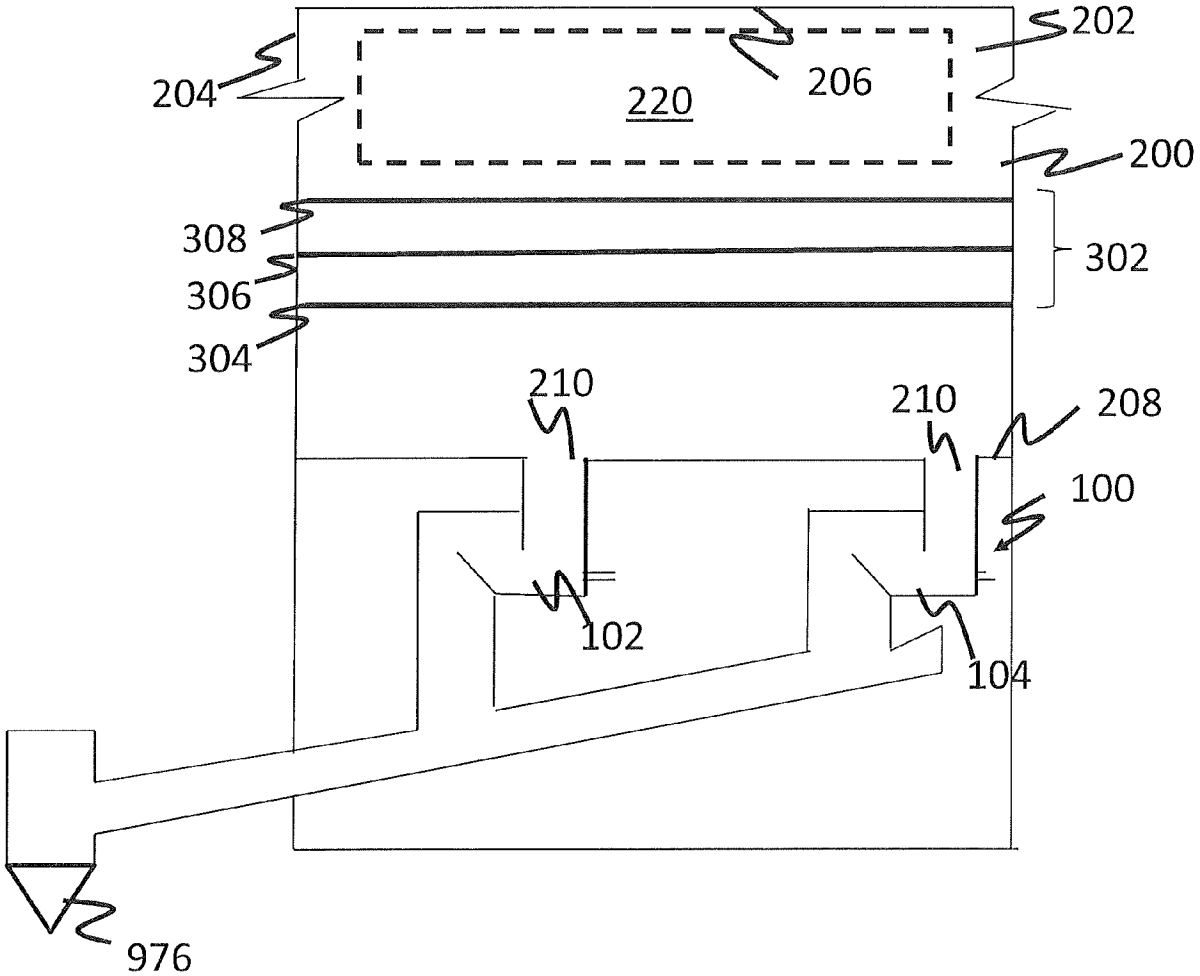
FIG. 3 is a depiction of an orifice plate.

FIG. 3 depicts one embodiment of the orifice plate 302. The orifice plate 302 comprises a plurality of plates 304, 306, 308 and so on. While the orifice plate 302 in the FIG. 3 comprises 3 plates, it can comprise 1 to about 10 plates, and specifically about 2 to about 6 plates. In an exemplary embodiment, the orifice plate comprises about 2 plates.

In the FIG. 3, the orifice plate 302 comprises three plates 304, 306, and 308, where the plate 304 is disposed beneath the plate 306, which is disposed beneath the plate 308. Each plate comprises a sheet of metal having orifices disposed therein. The orifices permit solids to pass through. In one exemplary embodiment, the orifices permits hot solids and/or ashes to pass from the moving bed heat exchanger to an ash flow control valve.

The plate 304 is referred to herein as the first plate or the lowest plate. The plate 306 is referred to as the second plate or the second lowest plate, while the plate 308 is referred to as the third plate of the third lowest plate. Each successive plate from bottom to top contains a larger number of orifices. The plate 304 has fewer orifices than the plate 306, which has fewer orifices than the plate 308. In one embodiment, the lowest plate 304 generally has the same number of orifices as the number of valves 102, 104. For example, if the lowest plate 304 has 4 orifices, then the number of valves in the flow control system will also be 4. In other words, in this embodiment, the number of orifices in the lowest plate 304 is the same as the number of openings 210 in the floor 208 of the moving bed heat exchanger 200. Each flow control valve can be considered as the final in a series of plates that constitute the orifice plate 302, with the number of valves equaling the number of orifices in the lowest plate. The floor 208 of the moving bed heat exchanger 200 is not considered to be a part of the orifice plate 302.

In another embodiment, the first plate or the lowest plate 304 has a larger number of orifices than the number of openings 210 in the floor 208 of the moving bed heat exchanger 200. Here too, the floor 208 of the moving bed heat exchanger 200 is not considered to be a part of the orifice plate 302.

In one embodiment, each successive plate (from bottom to top) in the orifice plate contains an increasing number of orifices that is dictated by the terms of a geometric sequence. In other words, each successive plate will contain a number of orifices dictated by a geometric sequence as follows:

a, ar, $ar^2$, $ar^3$, $ar^4$, . . . , where "a" is the scale factor and "r" is the common ratio.

In one embodiment, if the lowest plate contains 2 orifices, then the second lowest plate will contain 4 orifices, while the third lowest plate will contain 8 orifices. In this case, "a" is equal to 1 and "r" is equal to 2. In another embodiment, if the lowest plate contains 4 orifices, then the second lowest plate will contain 16 orifices, while the third lowest plate will contain 64 orifices. In this case, "a" is equal to 1, and "r" is equal to 4. While the aforementioned embodiment teaches that the number of orifices may be increased according to a geometric sequence from the lowest plate to the uppermost plate, other sequences may be used so long as the number of orifices increases from the lowest plate to the uppermost plate.

The diameter of each orifice is at least 3 times the maximum debri size, specifically at least 4 times the maximum debri size, and more specifically at least 5 times the maximum debri size that can cause blockage in the orifices or in the respective shoes 126 that are disposed downstream of the orifices. In one embodiment, the diameter is about 3 centimeters to about 16 centimeters. In another embodiment, the diameter is about 6 centimeters to about 8 centimeters. In one embodiment, the spacing between neighboring orifices in the lowest plate 304 is determined by the orifice size and the ash or solids angle of repose. In another embodiment, the spacing between neighboring orifices in the lowest plate 304 is about 8 to about 20 centimeters.

Figure 4:
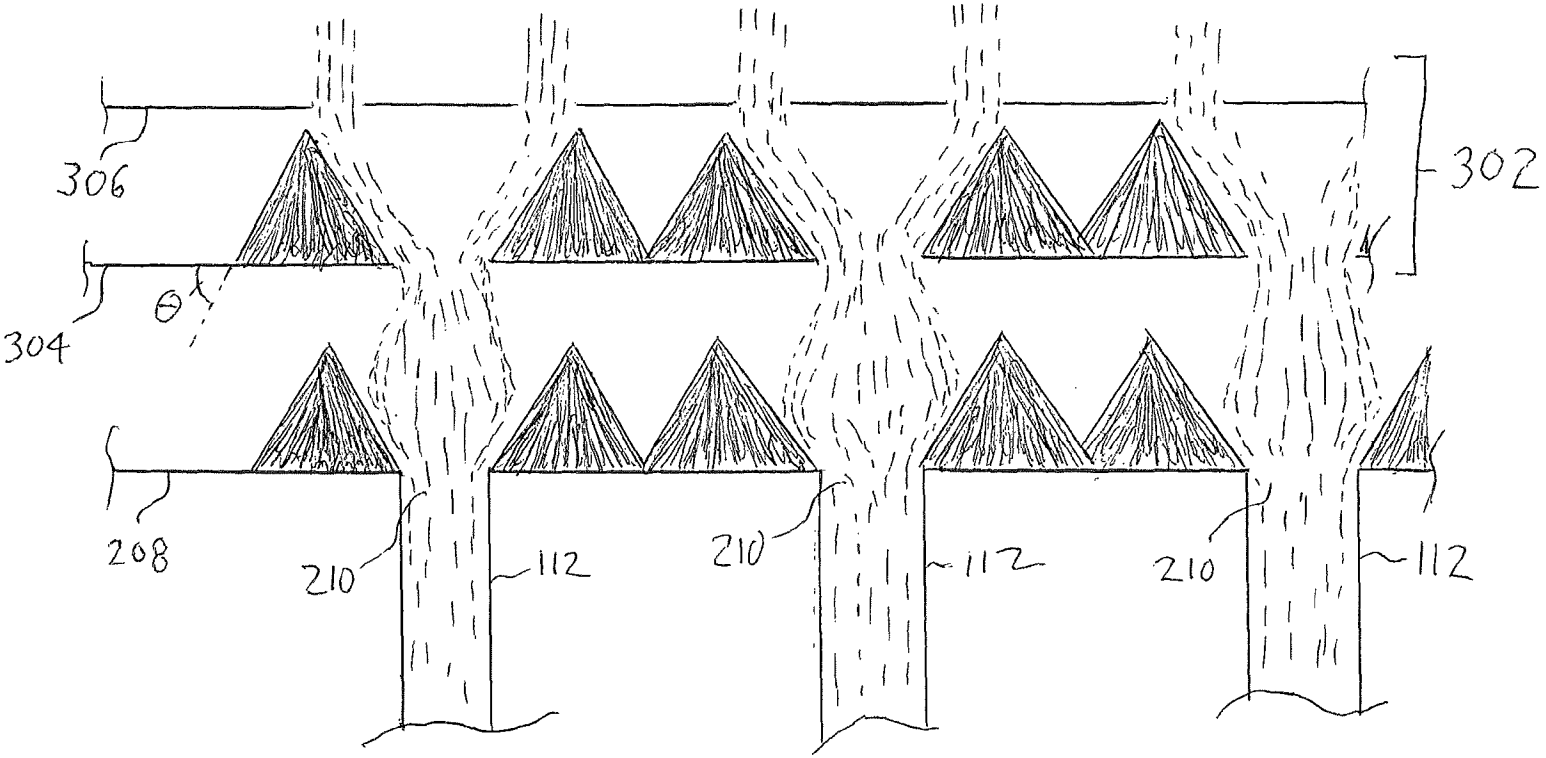
FIG. 4 depicts the arrangement of the orifices in the successive plates with respect to the openings in the floor of the moving bed heat exchanger.
Figure 5:
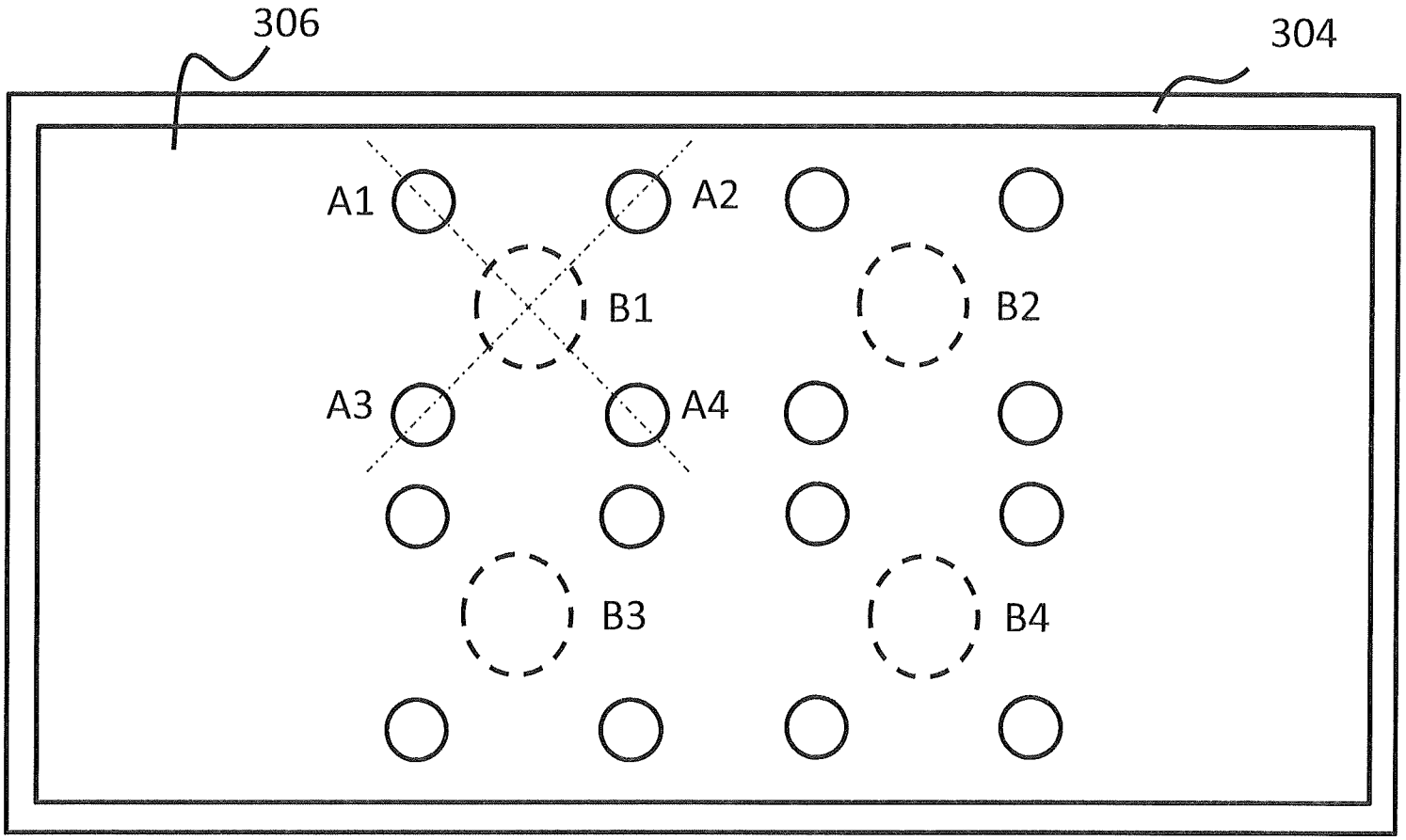
FIG. 5 shows only the arrangement of the orifices in the successive plates with respect to each other.

FIGS. 4 and 5 depict an arrangement of the orifices in the successive plates 304 and 306 with respect to each other. FIG. 4 represents a side view of the orifice plate 302, while the FIG. 5 represents a top view of the orifice plates. FIG. 4 and FIG. 5 are not depictions of each other. In other words, the FIG. 4 is not a side view of the FIG. 5 and vice-versa.

The FIG. 4 depicts an arrangement of the orifices in the successive plates 304 and 306 with respect to the openings 210 in the floor 208 of the moving bed heat exchanger 200. The FIG. 5 shows only the arrangement of the orifices in the successive plates 304 and 306 with respect to each other. As can be seen from the side view in the FIG. 4, the lowest plate 304 has fewer orifices than the second to lowest plate 306. The total area of the orifices in the lowest plate 304 is however about equal to the total area of the orifices in the second to lowest plate 306. It can be seen the orifices in the lower plate are coaxial with the openings 210 in the floor 208 of the moving bed heat exchanger, which are in turn coaxial with the standpipe 112 of the shoe 126.

In the FIG. 4 it can be seen that the cross-sectional area of the individual orifices in the lowest plate 304 are larger than the cross-sectional area of the individual orifices in the second to lowest plate 306. There are however more orifices in the plates that are disposed further away from the floor 208 of the moving bed heat exchanger than those disposed closer to the floor 208. As a result, there will be more orifices in the second to lowest plate 306 when compared with the lowest plate 304. The total area of the orifices in the lowest plate 304 is therefore greater than or about equal to the total area of the orifices in the second to lowest plate 306. The total area of the orifices in the plate 304 may be less than the area of the orifices in the plate 306, but this would restrict particle flow through the heat exchanger.

From the FIG. 4 it can also be seen that the center of each orifice in the lowest plate 304 is coaxial with a vertical line that represents the geometric center (the center of gravity or the center of rotation) of a plurality of orifices in the second to lowest plate 306. The FIG. 5 depicts this feature more clearly. The FIG. 5 represents a top view taken from above the second to lowest plate 306 towards the lowest plate 304. The FIG. 5 depicts a portion of the second to lowest plate 306 that overlaps with a portion of the lowest plate 304.

In the FIG. 5, the lowest plate 304 has 4 orifices (B1, B2, B3 and B4) (represented by dashed lines), while the second to lowest plate 306 has 16 orifices (represented by solid lines). Four of these orifices A1, A2, A3 and A4 of the second to lowest plate 306 discharge the hot solids and/or ashes to the orifice B1 of the lowest plate 304. Each orifice of the lowest plate 304 has a center that is coaxial with the geometric center of the 4 orifices that lie in the second to lowest plate 306 proximate to that particular orifice. In summary, each orifice of the lowest plate 304 (e.g., B1) has a center that is coaxial with the geometric center of the plurality of orifices (e.g., A1, A2, A3 and A4) that lie in the second to lowest plate 306 proximate to that particular orifice (e.g., B1). It is to be noted that while the orifices A1, A2, A3 and A4 lie at the vertices of a square, other locations for the orifices can also be chosen. For example, the orifices may lie along the perimeter of a circle or along the vertices (or the perimeter) of a polygon (e.g., a pentagon, a hexagon, or the like). Other irregular geometries may be chosen for locating the orifices. It is also to be noted that while the orifices in one plate may lie along the vertices of a first type of geometry (e.g., a square), the orifices in another plate may lie along the vertices or the perimeter of a second type of geometry (e.g., a pentagon or a circle). Generally, the entire flow from an orifice in an upper plate (second to lowest plate 306) flows into an orifice in a lower plate (e.g., the lowest plate 304). In the FIG. 5, while there are 4 orifices in the plate 306 per orifice in the plate 304, this ratio can be varied from 2:1 to 20:1 if desired.

The individual orifices in the plates or in the hoppers, which are detailed below may have a variety of cross-sectional geometries such as square, circular, rectangular, pentagonal or hexagonal. Other irregular geometries may also be used. In an exemplary embodiment, the cross-sectional geometry may be circular.

With reference once again to the FIG. 4, it may be seen that when the hot solids and/or ashes are discharged from the moving bed heat exchanger 200 towards the floor 208 they travel through the orifices in the second to lowest plate 306 towards the lowest plate 304. The angle of repose (θ) of the pile determines the dimensions of the cone of flowing hot solids and/or ash that piles upon on each of the orifice plates and on the floor 208 of the moving bed heat exchanger. As the hot solids and/or ash first travels through the orifices of the second to lowest plate 306, it forms a pile of matter on the lowest plate 304. The pile of matter has an angle of repose (θ) that is determined by the characteristics of the hot solids and/or the ash in the pile. After the pile is formed, the remaining hot solids and/or ash that travels through the orifices in the plate 306 travels down the slopes of the pile and into the orifice in the plate 304. This phenomenon repeats itself on the floor 208 of the moving bed heat exchanger 200. In other words, the pile of hot solids and/or ash formed adjacent to an orifice initially serves as a guide to direct the subsequent stream hot solids/and or ash into the orifices or openings that are down stream of the first orifice encountered by the stream of hot solids and/or ash. The angle of repose of a granular material is the steepest angle of descent or dip of the slope relative to the horizontal plane when material on the slope face is on the verge of sliding. When bulk granular materials are poured onto a horizontal surface, a conical pile will form. The internal angle between the surface of the pile and the horizontal surface is known as the angle of repose and is related to the density, surface area and shapes of the particles, and the coefficient of friction of the material. Material with a low angle of repose forms flatter piles than material with a high angle of repose. In general, the angle of repose for dry fine ash is about 30 to about 35 degrees, for wet fine ash is about 45 to about 90 degrees and for fly ash is about 40 degrees.

The angle of repose (θ) of the pile of hot solids and/or ash thus determines the minimum height between plates and the spacing between orifices in a given plate. The distance (height) between successive plates 304, 306 and 308 is thus determined by the angle of repose of the pile of ash. If the angle of repose of a pile of hot solids and/or ashes is too large (e.g., 75 degrees or greater), it may prevent the smooth flow of hot solids and/or ashes through the orifice above the pile. In one exemplary embodiment, the height between successive plates is greater than the height of a pile of hot solids and/or ashes.

The plates of the orifice plate are manufactured from high alloy steel, refractory tiles, or a combination thereof.

In another embodiment, the orifice plate 302 may be constructed of a plurality of truncated pyramidal hoppers in close proximity to each other as opposed to the flat surface of the orifice plate 302. The plurality of truncated pyramidal hoppers may be arranged in rows, one above the other, in much the same manner as the successive plates that form the orifice plate. This is depicted in the FIG. 6.

Figure 6:
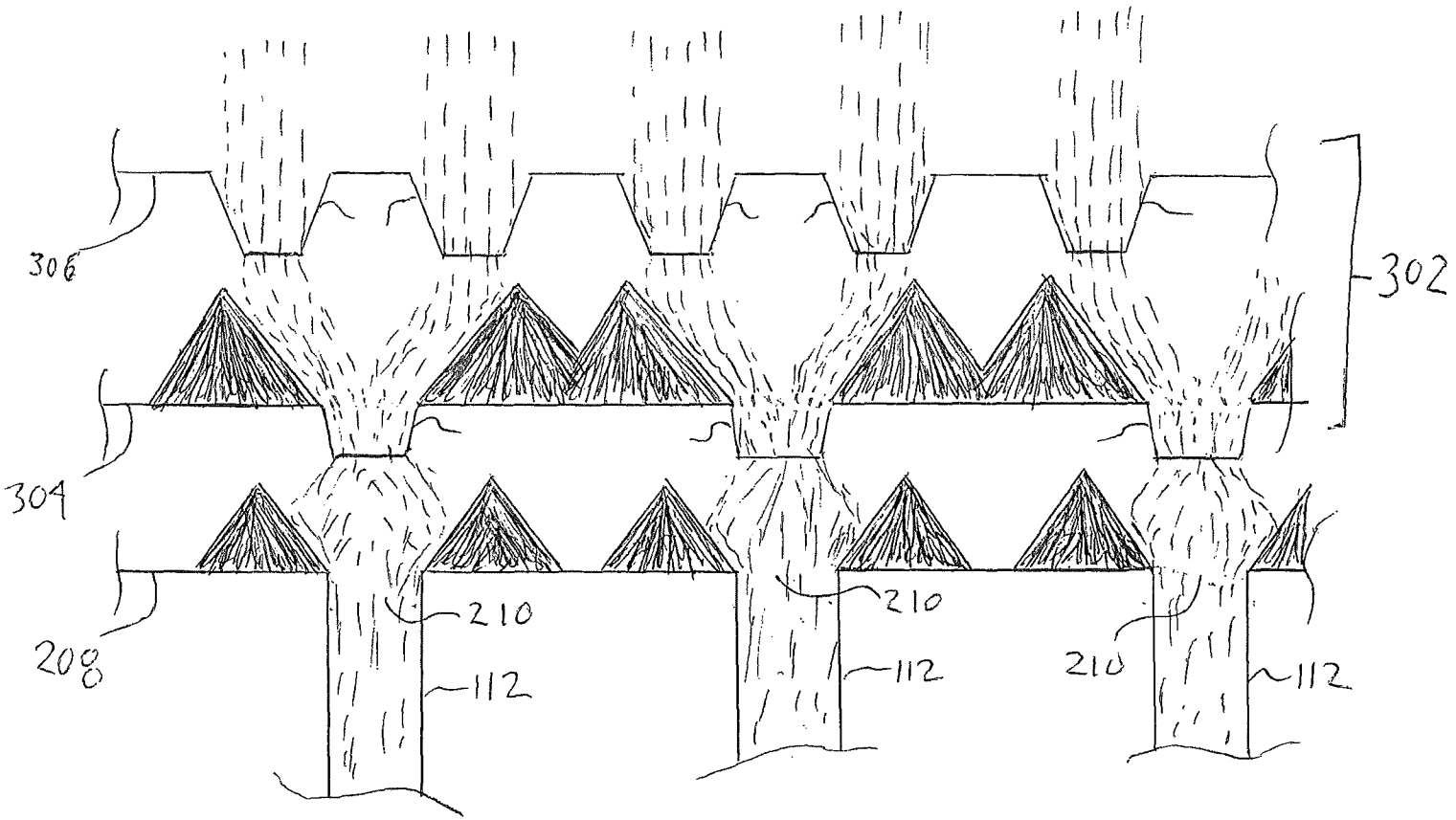
FIG. 6 is a depiction of an orifice plate that comprises a plurality of plates each of which comprise a plurality of hoppers with orifices.

The FIG. 6 depicts an orifice plate comprising the lowest plate 304 having a plurality of pyramidal hoppers and the second to lowest plate 306 also having a plurality of pyramidal hoppers though larger in number when compared with the lowest plate 304. As detailed above, the number of hoppers increases from the lowest plate 304 to the highest plate (which is furthest away from the floor 208 of the moving bed heat exchanger). The configuration and location of the hoppers and the size of the orifices in the hoppers follows the same logic described above with respect to the FIGS. 4 and 5. The height between the hoppers and the distance between the orifices of the hoppers is dictated by the angle of repose (θ) of the pile hot solids and/or the ash.

A moving bed heat exchanger with an associated flow control device that has an orifice plate has a number of advantages over a moving bed heat exchanger with an associated flow control device that has no orifice plate associated with it. The orifice plate provides uniform solids flow through the moving bed heat exchanger. It significantly reduces the moving bed heat exchanger height dimensions as compared with comparative moving bed heat exchangers that use mass flow hoppers. The orifice plate therefore ensures uniform solids flow throughout a moving bed heat exchanger without the excessive height dimensions needed with mass flow hoppers. Mass flow hoppers can also be used to ensure uniform solids flow, although with an excessive height dimension. In addition, when an orifice plate is not used in a moving bed heat exchanger, a much larger number of ash control valves are used, although this adds to the overall system complexity and cost of the flow control system as well as to the moving bed heat exchanger. A moving bed heat exchanger and a flow control system with an orifice plate thus uses fewer ash control valves as compared with a comparative moving bed heat exchanger and flow control system with no orifice plate.

The orifice plate is exemplified by the following examples, which are meant to be exemplary and not limiting.

EXAMPLES

Example 1

This example depicts the difference in the size of the moving bed heat exchanger when an orifice plate is used and when they are not used. Preliminary layouts of the moving bed heat exchanger indicate that ash flow distribution and control are important to the design. The original moving bed heat exchanger designs used mass flow hoppers with 70 degrees angles to ensure uniform solids flow throughout the moving bed heat exchanger. The hoppers are mounted above the standpipe 112 in the FIG. 2 shown above. This approach required a very tall moving bed heat exchanger or a moving bed heat exchanger with an excessive number of hoppers and ash control valves at the moving bed heat exchanger bottom. Use of the successive plates having orifices reduced the clearance height between the moving bed heat exchanger tube bundles and the inlet to the ash control valves by one third.

An orifice plate system having 2 plates was therefore developed to reduce the height requirements. The height between the plates is about 29 centimeters. The number or orifices in the first plate (the lowest plate) was 4, while the number of orifices in the second plate (the second lowest plate or the upper plate) was 16. The multiple orifice plate design resulted in the use of hoppers with angles (ϕ) of 30 degrees to 35 degrees (instead of 70 degrees), resulting in a 60 percent to 70 percent height reduction in the distributor. This may be seen in the FIG. 6.

Example 2

This example depicts the difference in performance between a moving bed heat exchanger without an orifice plate and one with an orifice plate. Four ash control valves as depicted in the FIG. 1 were installed in the flat floor region below the moving bed heat exchanger with the hope that the ash would distribute itself uniformly at some level above the inlet of the ash control valve representing an internal solids angle of friction of 70 degrees.

The 70 degree angle of friction exists for a short distance above the ash control valve inlet, then a solids plume extends upward to the top as shown in the photograph of the FIG. 7. A dead volume of ash exists between the plumes as can be seen by the dark region of the FIG. 7. Operation of the slice model without orifice distribution plates shows that ash flow plumes extended from the top of the ash column down to the ash control valve with little spreading of the plume. This indicated that the ash by itself will not be distributed adequately.

Figure 8:
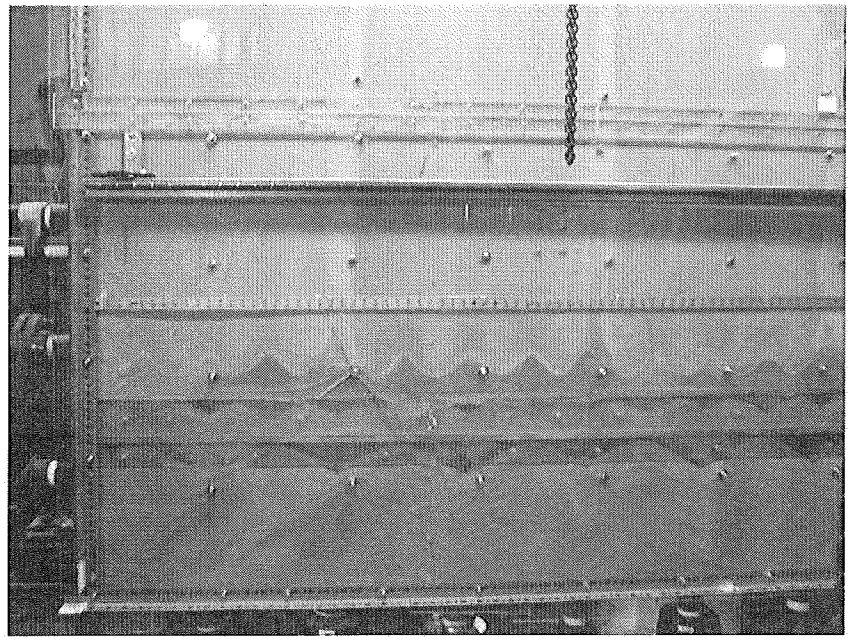
FIG. 8 is a photograph of a slice model of a moving bed heat exchanger that has an orifice plate.

Installing two plates above the ash control valve inlet provides good distribution of ash flow throughout the slice model. This can be seen in the FIG. 8, where the plumes are substantially minimized.

In summary, an orifice plate comprising two plates (with orifices) were installed above the ash control valve inlets to provide a uniform ash flow distribution through the tube bundle of the moving bed heat exchanger while reducing the height of the moving bed heat exchanger and minimizing the number of ash control valves.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

While the invention has been described with reference to a preferred embodiment and various alternative embodiments, it will be understood by those skilled in the art that changes may be made and equivalents may be substituted for elements thereof without departing from the scope of invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A moving bed heat exchanger comprising:

an enclosure having side walls, a roof and a floor;

a tube bundle disposed within the enclosure; the tube bundle being operative to transport a cooling fluid; wherein the spaces between tubes of the tube bundle are operative to permit transport of hot solids and/or ash therebetween;

an orifice plate disposed downstream of the tube bundle in the direction of the flow of hot solids and/or ash, the orifice plate including a plurality of vertically spaced plates, each of the plates defining a fewer number of orifices of larger diameter than that of the plate above, a total cross-sectional area of the orifices in each of the plates being substantially equal; and a plurality of valves disposed downstream of the orifice plate in the direction of the flow of hot solids and/or ash and vertically aligned with the orifices of the lower plate to receive the hot solids and/or ash passing through the orifice plate.

2. The moving bed heat exchanger of claim 1, wherein the orifice plate comprises 1 to about 10 plates vertically spaced and each having a plurality of orifices, wherein the orifices of adjacent plates are not aligned.

3. The moving bed heat exchanger of claim 1, each of the adjacent plates defining a number of orifices determined by successive terms of a geometric sequence.

4. The moving bed heat exchanger of claim 1, wherein each of the plates is disposed closer to the plurality of valves than the plate above.

5. The moving bed heat exchanger of claim 3, wherein a lower one of the plates comprises four orifices and the plate above the lower plate comprises 16 orifices.

6. The moving bed heat exchanger of claim 1, wherein the plurality of valves have a height that is about 60 to about 80% less than a comparative valve that does not have the orifice plate.

7. The moving bed heat exchanger of claim 4, wherein a distance between a lower one of the plates and the plate above the lower plate is determined by an angle of repose of the hot solids and/or ash.

8. The moving bed heat exchanger of claim 4, wherein a spacing between the orifices in a lower one of the plates and the plate above the lower plate is determined by an angle of repose of the hot solids and/or ash.

9. The moving bed heat exchanger of claim 4, wherein a vertical offset between the orifices in a lower one of the plates and the plate above the lower plate is determined by an angle of repose of the hot solids and/or ash.

10. The moving bed heat exchanger of claim 1, where the orifice plate comprises a high alloy steel, refractory tiles, or a combination thereof.

11. The moving bed heat exchanger of claim 4, where a center of the orifice in a lower one of the plates is coaxial with the center of rotation of a plurality of orifices in a plate above the lower plate.

12. The moving bed heat exchanger of claim 1, wherein each valve includes:

a standpipe that receives the hot solids and/or ash from the lower plate; and a housing including a shoe that receives the hot solids and/or ash from the standpipe.

13. The moving bed heat exchanger of claim 1, wherein the orifices of the adjacent plates are not vertically aligned.

* * * * *